US006267412B1

(12) United States Patent
Henderson

(10) Patent No.: US 6,267,412 B1
(45) Date of Patent: Jul. 31, 2001

(54) WINDOW POCKET INSERTION AND REMOVAL DEVICE AND METHOD

(76) Inventor: James E. Henderson, 3502 Jasmine Ave., #101, Los Angeles, CA (US)

( * ) Notice: Subject to any disclaimer, the term of this patent is extended or adjusted under 35 U.S.C. 154(b) by 0 days.

(21) Appl. No.: 09/095,461

(22) Filed: Jun. 10, 1998

(51) Int. Cl.[7] ..... B42D 15/00

(52) U.S. Cl. ..... 281/15.1; 281/28; 281/51; 402/80 R

(58) Field of Search ..... 281/15.1, 28, 51; 402/80 R, 80 P; 30/1, 2, DIG. 8

(56) References Cited

U.S. PATENT DOCUMENTS

| | | | | |
|---|---|---|---|---|
| 231,349 | | 8/1880 | Norton . | |
| 512,267 | | 1/1894 | Austrian . | |
| 1,287,329 | | 12/1918 | Jennings . | |
| 1,677,277 | | 7/1928 | Federbush . | |
| 1,751,181 | | 3/1930 | Williams . | |
| 1,805,314 | | 5/1931 | Morton . | |
| 2,207,930 | | 7/1940 | Miller . | |
| 2,412,255 | | 12/1946 | Ferguson . | |
| 2,707,325 | * | 5/1955 | Cripps | 30/1 |
| 3,186,114 | | 6/1965 | Carter . | |
| 3,663,041 | | 5/1972 | White . | |
| 3,814,527 | | 6/1974 | Lawes . | |
| 4,070,223 | | 1/1978 | Stalzer . | |
| 4,242,928 | | 1/1981 | Haley . | |
| 4,319,703 | | 3/1982 | Gann . | |
| 4,417,757 | | 11/1983 | Morrison . | |
| 4,448,558 | | 5/1984 | Weingarten . | |
| 4,528,795 | | 7/1985 | Stemmer . | |
| 4,596,482 | | 6/1986 | Salzer . | |
| 4,681,472 | | 7/1987 | Ruble . | |
| 4,848,799 | | 7/1989 | Turetsky . | |
| 4,892,333 | * | 1/1990 | Krulich | 281/31 X |
| 4,998,840 | | 3/1991 | Ruble . | |
| 5,148,599 | * | 9/1992 | Purcell | 30/1 |
| 5,330,279 | | 7/1994 | Ruble . | |
| 5,405,177 | | 4/1995 | Goldstein . | |
| 5,439,263 | | 8/1995 | Chambers . | |
| 5,540,471 | | 7/1996 | Whitney . | |

* cited by examiner

*Primary Examiner*—Willmon Fridie, Jr.
(74) *Attorney, Agent, or Firm*—Anna M. Vradenburgh; Gregory A. Piccionelli

(57) ABSTRACT

A thin window pocket insertion and removal device comprising an elongated body (12) having a first end (11) and a second end (13), a frictional element (19) adhered to one side of the elongated body (12), and a lip portion (18) protruding from the second end (13) of the elongated body (12). In some preferred embodiments, the device (10) further includes a handle portion (14) and a stop portion (30) protruding from the handle (14). The elongated body (12) is made of a flexible but sufficiently rigid material so as to resist warping and breakage during use or when not in use. Further, in some embodiments, the elongated body (12) includes one or more apertures (16), (17) all of which act to facilitate storage.

25 Claims, 4 Drawing Sheets

WINDOW POCKET INSERTION AND REMOVAL DEVICE AND METHOD

FIELD OF INVENTION

This invention is directed to a device and method for inserting and removing sheet material and the like into and from a window pocket capable of retaining sheet material and the like; more particularly, a device for inserting and removing sheet material, such as, for example, labels, into the window pockets on binder spines.

BACKGROUND OF THE INVENTION

Since its inception, the three-ring loose-leaf document binder has proven to be an effective method for retaining documents. After a period of time, the three-ring binder was improved with the placement of a clear plastic window pocket on both the front cover and the spine portion of the binder. Generally, these window pockets are sealed to the outer covering of the body of the binder along their longitudinal edges and bottom, thereby allowing for the placement of sheet material, e.g., paper or nonadhesive labels, between the plastic window and the binder. This enabled the binder to be clearly labeled with a description of its contents, a name, a logo, or any combination thereof, without the high cost of having the binder individually printed. Further, it alleviated the need to use adhesive labels which can become soiled, damaged and unsightly after a period of time, and further, are often difficult to remove. In contrast to the adhesive labels, the sheet material, which is slid between the clear plastic forming the window pocket and the body of the binder, is protected from wear and damage. With the option of being changed, sheet material allows for relabeling and hence the reuse of the binder with either the same documents or others of a different topic.

Placing sheet material into the front cover window pocket proved an easy task. However, with respect to the spine window pocket, due to its length in relation to the body of the binder, and the snugness of the window pocket, the sheet material proved difficult, to sometimes impossible, to insert into the window pocket without wrinkling, tearing or otherwise causing irreparable damage to the sheet material itself. Further, both the spine of the document retainer, as well as the clear plastic window pocket, could be subject to damage if a pen, scissors or similar sharp object were used to force the sheet material into the window pocket. This problem results in not only a costly waste of materials, but also a waste of time due to the difficulty of inserting the sheet material. Indeed, if a large number of binders are required, which often happens in the commercial settings where these binders are used for a wide range of uses, the problem is compounded. In addition to the problems associated with inserting the sheet material, it is also quite difficult to remove the sheet material from the spine window pocket without damaging the spine window pocket or the binder itself.

In an attempt to overcome the above problems, inventors created devices which would allow the user to insert sheet material into the spine window pocket without damaging the sheet material or the window pocket. For instance, U.S. Pat. No. 4,681,472 ('472) to Ruble discloses a self-loading binder which incorporates an elongated label leader pre-installed within the spine window pocket of an overlay binder. However, this system is not universally usable in that it limits the use of the leader to the specific binder to which it is pre-installed, thereby increasing expense to manufactures and failing to resolve the problem for other binders with window pockets. In addition, the adhesive element can cause damage to the sheet material, and eventually, may lose its "sticky" quality and thus, prove impractical for long-term use.

U.S. Pat. No. 4,998,840 ('840) to Ruble discloses an improvement on the '472 reference by incorporating a tool which may retrofit the elongated label leader into an overlay binder which has not been pre-installed with the elongated label leader. Nonetheless, the problems cited above are not addressed, and further increases the expense of solving the same problem.

Further, U.S. Pat. No. 5,330,279 ('279) to Ruble discloses a leader having a loop portion, an improvement to the '472 reference, whereby the adhesive portion of the leader is peeled from the label as opposed to sheering the label away as in the previous references. Nonetheless, this reference too fails to provide a universal tool.

Another type of device was introduced by U.S. Pat, No. 4,892,333 to Krulich. The Krulich reference discloses a window pocket insertion device incorporating two elongated flat prongs which shield the sheet material from damage during insertion. Although this device may be universally used, each prong must be thin enough such that together they fit between the window pocket and the binder. The thinness of the prongs increases the frailty of the device, and exposes the device to being easily damaged.

A need exists in the industry for a compact, yet sturdy, and easy to use tool for inserting and removing sheet material from a binder window pocket without imparting damage to the sheet material or binder.

SUMMARY OF THE INVENTION

An object of embodiments of the instant invention is to provide a device and method for inserting sheet material into window pockets which will work with all items having such window pockets.

Another object of embodiments of the instant invention is to provide a device and method for inserting sheet material into window pockets which would not require retrofitting or any additional devices thereof.

Still another object is to provide a device and method which would effectively accomplish both the insertion and removal of sheet material from window pockets.

Another object is to provide a device and method for inserting and removing sheet material which would minimize the possibility of damage to both the sheet material and the window pocket during proper use.

A further object of embodiments of the invention is to provide a device which allows for convenient storage.

Still a further object of embodiments of the invention is to provide a device which can be produced in a variety of colors and styles.

Another object of embodiments of the invention is to provide a kit, wherein elements of the device are interchangeable such that different size devices can be formed for more efficient use.

Further objects and advantages are to provide a device and method which can be used quickly and easily, which is simple and inexpensive to manufacture, which obviates the need to use adhesive labels, and which will provide a more productive method for the user, especially during times when expedient servicing of binders is necessary. Still further objects and advantages will become apparent from a consideration of the ensuing description and drawings.

Preferred embodiments of the insertion and removal device comprise an elongated body having a first end and a second end, a handle and a frictional element. The elongated body further includes a lip portion. The lip portion protrudes outward from the elongated body and assists in the removal of the sheet material by catching the bottom of the sheet material such that it can be pulled upwards.

The handle resides adjacent the first end of the elongated body and further includes an aperture for easily storing the device by hanging it on a hook or other receptacle. A frictional element is disposed along the longitudinal direction of the elongated body. The frictional element aids in removing the sheet material from the binder as it is capable of adhering to the sheet material such that it can be guided or positioned within the pocket.

BRIEF DESCRIPTION OF THE DRAWINGS

The detailed description of embodiments of the invention will be made with reference to the accompanying drawings, wherein like numerals designate corresponding parts in the FIGS.

DETAILED DESCRIPTION OF PREFERRED EMBODIMENTS

Figure 1:
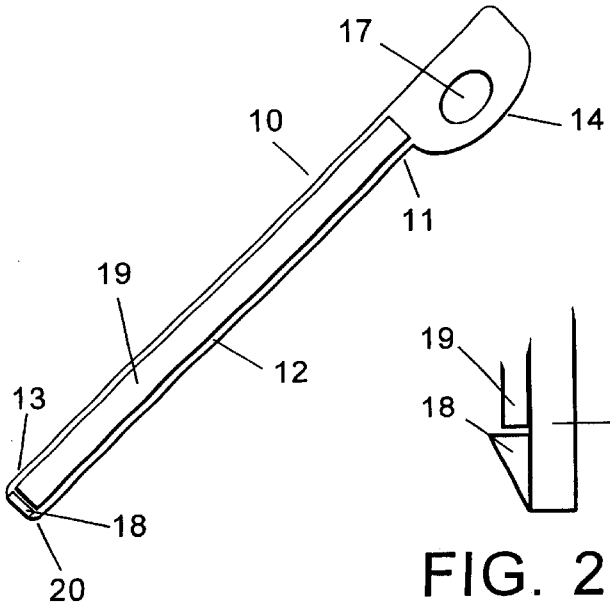
FIG. 1 shows a preferred embodiment of a sheet material insertion and removal device.

FIG. 1 depicts a perspective view of a preferred embodiment of the sheet material insertion and removal device of the present invention. In FIG. 1, the insertion and removal device 10 includes an elongated body 12 having a first end 11 and a second end 13, a handle is 14, a lip portion 18 and a frictional element 19.

The elongated body 12 of the device 10 is uniform in thickness and is composed of a flexible material which resists permanent warping or breakage and slides easily against a variety of materials, such as, for example, plastics, paper material, vinyl, nylon, leather, various fibrous materials, various plasticized materials, various coated materials, various metallic materials, wood and cardboard. In one preferred embodiment, the elongated body 12 is made from a rigid but flexible material such as, but not limited to, phenolic and stainless steel. However, any material having sufficient rigidity for use which is resistant to permanent warping or breakage is suitable. In other preferred embodiments, the elongated body 12 is coated or treated to have a low friction characteristic. Still in other preferred embodiments, the elongated body 12 is machined to form the low friction characteristic.

Typically, the elongated body 12 ranges in size from about 252 mm to about 290 mm in length, and has a width of about 18.0 mm, although any size lengths and widths for use with a larger or smaller, or wider or thinner retainer, e.g., a window pocket, is suitable. In some preferred embodiments, the elongated body 12 is 0.5 mm–0.8 mm thick, although any thickness that allows the body 12 to insert and remove the sheet material from a retainer, e.g., a window pocket for a binder spine, is suitable.

The second end 13 of the elongated body 12 further includes rounded corners 20. The rounded corners 20 aid in preventing damage to the sheet material or window pocket during the insertion and removal of the sheet material. In some preferred embodiments, the second end 13 does not have rounded corners 20.

Figure 4A:
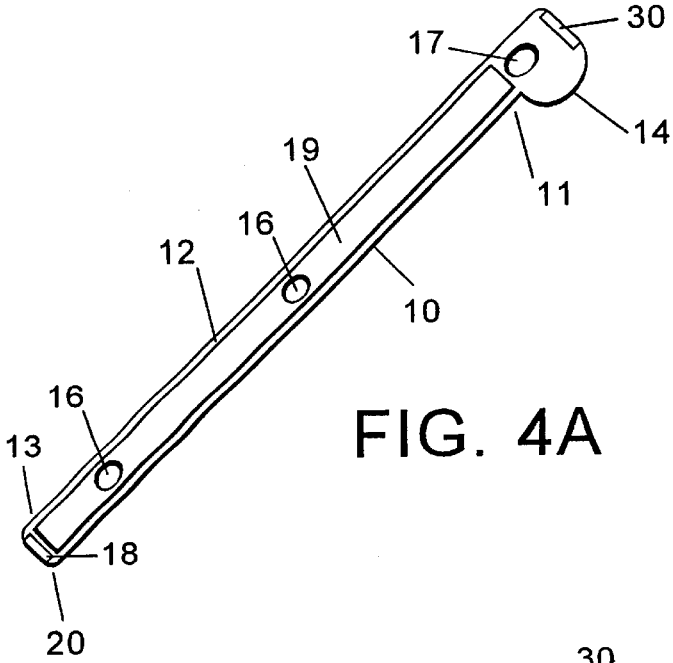
FIG. 4A depicts another preferred embodiment of a sheet material insertion and removal device having three apertures.
Figure 5:
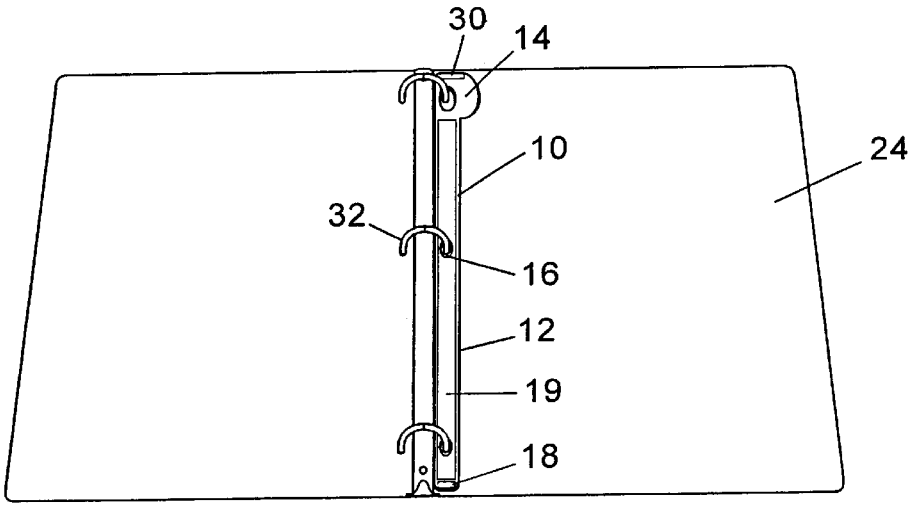
FIG. 5 shows the sheet material insertion and removal device of FIGS. 4A and 4B stored within a three-ring loose-leaf document binder.

In another preferred embodiment, shown in FIG. 4A, the elongated body 12 includes a plurality of apertures 16 and a stop flange 30. The apertures 16 are positioned along the elongated body 12 such that the device 10 may be stored in a suitable retainer, such as, for example, a three-ring binder 24, as shown in FIG. 5. The apertures 16 are substantially circular in shape, although any shape, such as, for example, an oval or a square, is suitable. The sizes of the apertures 16 may be equivalent to one another or not, and may be sized appropriately to facilitate storage, for example, in a ring binder, and/or by hanging and may be any size which would not diminish the structural integrity of the device 10. Typically, the diameter of the aperture 17 nearest the first end 11 is 9 mm, although any diameter size capable of fitting over a hook or clasp is suitable. In one preferred embodiment, the diameter of the remaining apertures 16 are 6 mm.

Figure 4B:
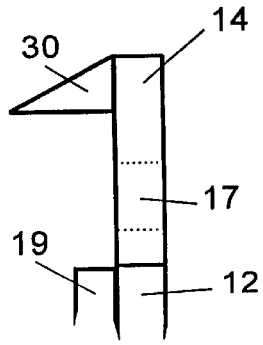
FIG. 4B depicts a preferred embodiment of a stop portion of FIG. 4A.

The stop flange 30 resides adjacent the handle 14 and protrudes outward therefrom, see FIG. 4B. The stop flange 30 further facilitates the storage of the device 10 as the stop flange 30 allows the device 10 to be hooked onto, for example, the top of the binder 24, if so desired. In one preferred embodiment, the stop flange 30 has a width of approximately 12.7 mm, a length of approximately 3 mm and protrudes approximately 2.6 mm to 4.6 mm outward from the top of handle portion 14.

For ease of control of the insertion and removal device 10, a handle 14 is disposed adjacent the first end 11 of the elongated body 12. In one preferred embodiment, the handle 14 is hemispherical in shape and further includes an aperture 17. The handle 14 can either be permanently coupled to the first end 11 or detachably coupled thereto. In some preferred embodiments the handle 14 and the elongated body 12 are manufactured as a single unitary piece.

In some preferred embodiments, the handle 14 further includes a concave portion (not shown), wherein the concave portion is suitable for the placement of a user's thumb and allows the user to comfortably hold the device 10. In other preferred embodiments, the handle 14 further includes a textured surface, wherein the textured surface provides for increased gripping ability. The textured surface may be formed by any suitable process, such as, for example, an extrusion process or application of a separate adhesive element.

The aperture 17 of the handle 14 facilitates the storage of the device 10 by enabling it to be hung on a hook or other appropriate means when it is not in use. In one preferred embodiment, the aperture 17 has a diameter of approximately 11 mm, although any diameter size capable of fitting over a desired hook is suitable. Some preferred embodiments do not include an aperture 17. In preferred embodiments wherein the elongated body 12 includes a plurality of apertures 16 (shown in FIG. 4A), the aperture 17 in the handle 14 is aligned with the apertures 16 in the elongated body 12, thereby facilitating storage of the device 10 within a retainer, such as, for example, a binder, as shown in FIG. 5. The apertures 16, 17 may be formed by molding, cutting, drilling, punching, machining, or any other appropriate means.

Although FIG. 1 depicts a handle 14 having a hemispherical shape, any shape, including, but not limited to, for example, elliptical, octagonal or triangular is suitable. The handle 14 is composed from any material that is flexible, but retains an amount of rigidity for sturdiness. Preferred embodiments of the handle 14 are made from, for example, a heavy plastic. Typically, the handle 14 measures approximately 25 mm to 45 mm in length and 30 mm in width, although any length and width that allows handling of the device 10 is suitable. Indeed, the handle 14 can be thicker than the elongated body.

Figure 2C:
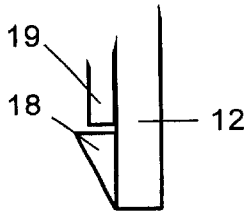
FIGS. 2A and 2C depict a top and back perspective view, respectively, of a preferred embodiment of the lip portion protruding from an end of the device in FIG. 1.
Figure 2A:
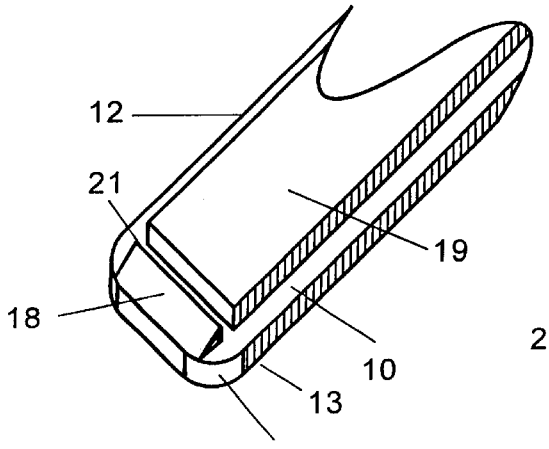

To aid in the removal of the sheet material from the window pocket, the device 10 includes a lip portion 18, or flange. FIGS. 2A and 2C depict a preferred embodiment of the lip portion 18. As shown in FIG. 2A, the lip portion 18 resides adjacent the second end 13 of the elongated body 12 and includes an edge 21 which protrudes out from the body 12. The lip portion 18 can be separately manufactured from the body 12 and coupled to the body 12 by, for example, welding or gluing, or the lip portion 18 and body 12 can be manufactured as a single unit.

Typically, the lip portion 18 must be small enough to fit between the window pocket and the spine of the binder, but large enough to catch the edge of the sheet material during removal. The minimum effective height and angle of the lip portion 18 relative to the elongated body 12 is related to the thickness of the frictional element 19 or lack thereof. The angle of the lip portion 18 preferably ranges from about 4°–14.7°. In one preferred embodiment wherein no frictional element is present, the lip portion 18 extends a minimum height of 0.3 mm at an angle of approximately 4° from the body 12. In another preferred embodiment including a frictional element with a minimum thickness of 0.5 mm, the lip portion 18 extends to a height of 1.3 mm at a minimum angle of about 14.4°. In another preferred embodiment, the lip portion 18 is 5 mm long and 11 mm wide, and protrudes outwardly approximately 0.8 mm to 1.3 mm from the elongated body 12, wherein it has a protrusion of 0.3 mm greater than the thickness of the frictional element 19. In some preferred embodiments, the combined thickness of elongated body 12, the frictional element 19, and the protrusion of lip portion 18 ranges from approximately 1.3 mm–1.8 mm, although any combination sufficiently thin to easily slide in and out of window pocket 26 is suitable. Typically, the lip portion 18 height exceeds that of the frictional element 19 by approximately 0.3 mm.

Figure 2B:
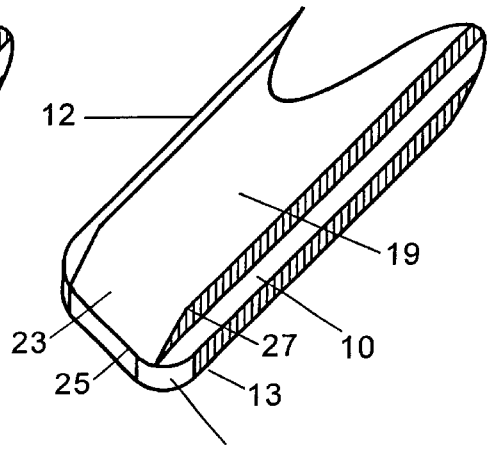
FIG. 2B depicts a preferred embodiment of the device in FIG. 1 without the lip portion.

In another preferred embodiment, as shown in FIG. 2B, the device 10 does not include a lip portion 18 at the second end 13. A lip portion 18 is not included in all preferred embodiments.

During the insertion and removal of the sheet material, the sheet material adheres to the frictional element 19. As shown in FIGS. 1 and 4A, in some preferred embodiments, the frictional element 19 is a single strip which is coupled to the elongated body 12. In other preferred embodiments, the frictional element 19 is comprised from a plurality of elements (not shown) which can be positioned with or without space from each other along the longitudinal length of the elongated body 12. Typically, the frictional element 19 is coupled to the same side of the elongated body 12 as the protrusion of lip portion 18.

In some preferred embodiments, as shown in FIG. 2B, the frictional element includes a tapered end 23. The tapering of the end 23 facilitates the passage of the device 10 beyond the top edge of the previously inserted paper during the removal process. Further, to prevent snagging of the paper the tapering must be smooth. The horizontal length of the tapered section, as measured from the tip 25 of the tapered end 23 to the point of full thickness 27 of the frictional element 19 as measured along the bottom edge of the frictional element 19, ranges from about 3–4 mm. For embodiments having a frictional element of 1.0 mm, a 3 mm horizontal length tapered end 23 is angled at about 18.7°, and a 4 mm horizontal length tapered end 23 is angled at about 14.2°. The vertical length, e.g., the hypotenuse of the triangle, is determined by the angle and the horizontal length.

In some preferred embodiments (not shown), the tapered end 23 could effectively equal the full length of the frictional element 19. In these embodiments, the angle of the taper would very gradually change.

To further enhance the smoothness of the tapered end 23, some preferred embodiments include a coating that is applied to the tapered end 23. In one preferred embodiment, the coating applied is Instant Krazy® Glue, distributed by Borden, Inc., of Columbus, Ohio.

The frictional element 19 has a substantially uniform cross-section and may be formed from any material which will provide a surface that easily slides against the window pocket 26, i.e., the outer surface of the body of the document retainer, but be frictional enough to cling to sheet material 22 under the conditions presented during the sheet material 22 removal process. The frictional element 19 may be formed, for example, from materials including, but not limited to, cork, rubber, leather, latex, plasticized materials, coated materials, or any combination thereof. In one preferred embodiment, the frictional element 19 is formed from a combination of cork and rubber such as that found in the product 4-Piece Material Assortment Pak, which is available from Nea Products Company of Bellevue, N.J. Still in another preferred embodiment, the frictional element 19 is made from cork. In other preferred embodiments, the frictional element 19 is formed from a rubber-fiber or a rubber cellulose material, such as those marketed by Nea Products Company of Bellevue, N.J.

In some preferred embodiments, the frictional element 19 ranges from approximately 248 mm–285 mm in length, 12.0 mm in width with a thickness of approximately 0.5 mm to 1.0 mm. Other preferred embodiments allow for both an increased and decreased width measurement of the body 12 and/or the frictional element 19 for use with wider and slimmer window pockets. As the elongated body 12 imparts friction to the pocket, it is preferable that the surface area that the elongated body 12 presents to the pocket be minimized or that the pocket facing surfaces of the elongated body 12 be composed of a relatively low friction material.

Conversely, the frictional element 19 should present a large enough surface area or be composed of a material that imparts sufficient friction to capture a label or insert previously inserted into the pocket.

In another preferred embodiment, no frictional element 19 separately exists in the device 10, but rather, a surface texture is formed on the elongated body 12 such that the properties of a separate frictional element 19 are found thereon, for example, the adhesive properties to remove an insert. The frictional surface portion of the elongated body 19 could be formed by, for example, molding or tooling. In another preferred embodiment, the frictional surface portion of the elongated body 19 may be made by coating or treating to effectuate the properties of the frictional element 19.

With exception of embodiments which include a separate frictional element 19, the device 10 may be formed as a single unit or as individual elements by the extrusion of liquid material into a molding device. Other processes for manufacturing the device 10 or components of the device 10 include, but are not limited to, stamping, pressing, cutting and forging the device 10 as a single piece or forming the device 10 in separate elements and joining the individual elements by any appropriate means, including, but not limited to, gluing or welding.

In operation, a user inserting sheet material into a window pocket utilizing the device 10 would first form a fold 28 at the bottom end of sheet material 22 (shown in FIG. 3) to form a folded portion 29 substantially coterminous with the width of the insert. In some preferred embodiments, the folded portion 29 is folded to the back or non-printed side of sheet material 22. The folded portion 29 may be any convenient length. In one preferred embodiment, the length of the folded portion 29 is approximately 6.5 mm. In other preferred embodiments, the minimum length of the folded portion 29 is 3 mm.

Figure 3:
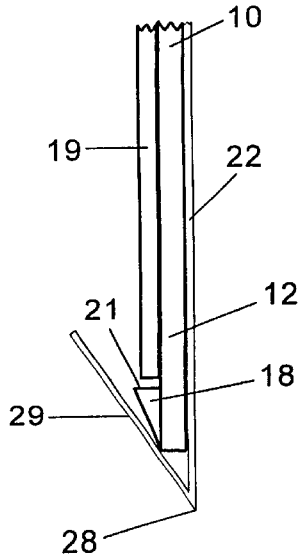
FIG. 3 depicts a back perspective of the preferred embodiment of the sheet material insertion and removal device of FIG. 1 having the lip portion positioned within the fold of a piece of sheet material.
Figure 6A:
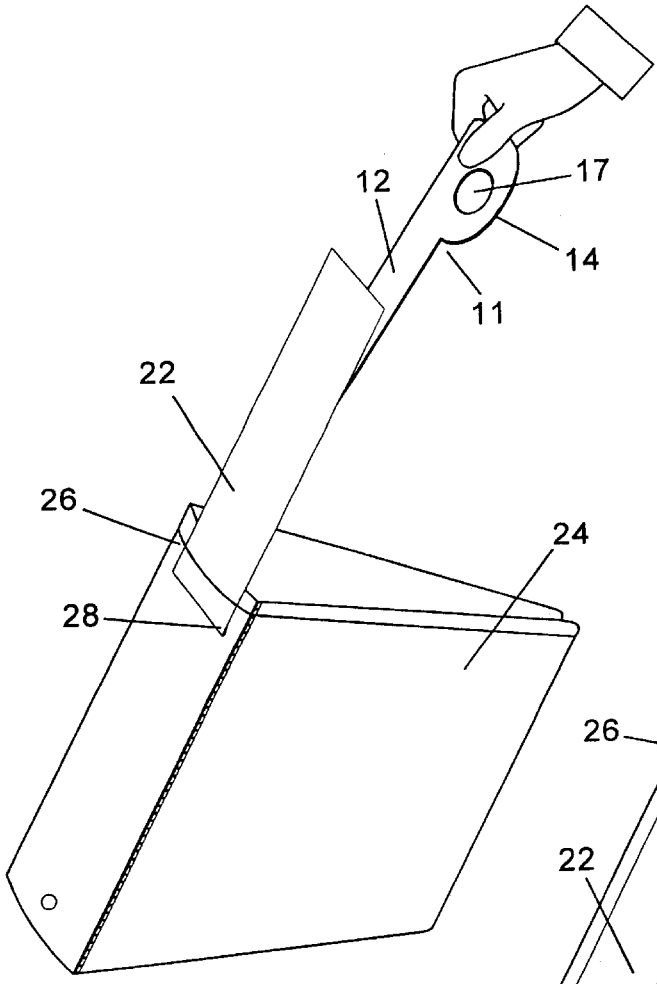
FIGS. 6A and 6B depict the sheet material insertion and removal device of FIG. 1 in the beginning stage of inserting sheet material into the window pocket of a binder and at the point of full insertion.
Figure 6B:
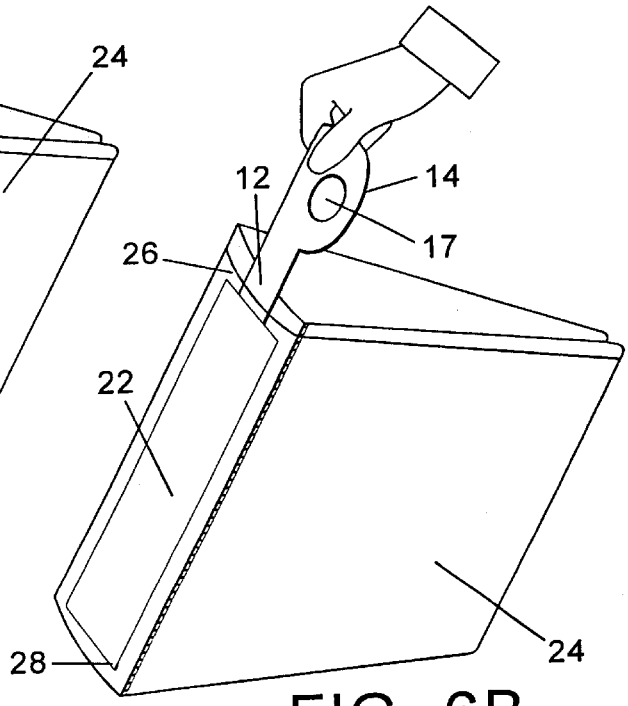

The second end 13 of the device 10 is then placed into the fold 28. In some preferred embodiments, the device 10 is placed into the fold with the lip portion 18 generally facing the back or non-printed side of sheet material 22 as depicted in FIG. 3. To aid in securing the position of the device within the fold 28 of the sheet material 22 and inserting the device 10 and the sheet material 22 into the opening of the window pocket 26, the user holds both the device and sheet material 22 between the thumb and index finger at a point closer to the second end 13 of the elongated body 12 than the first end 11 of the elongated body 12. Once the device 10 and sheet material 22 is inserted into the window pocket, as shown in FIG. 6A, the user applies an inward force, relative to window pocket 26, onto the device and fully inserts the sheet material 22 into the window pocket 26 (FIG. 6B). Because the device 10 and sheet material 22 lie flush along their longitudinal axis at the point of full insertion, adjustments for accurate positioning can be easily facilitated during the insertion process.

Once the sheet material is fully inserted into the window pocket, to remove the device 10, the user would apply a slight amount of finger pressure to the outer overlay surface of window pocket 26 at a point at the bottom end of sheet material 22 and an outward force relative to window pocket 26 onto the device 10. This facilitates removal of the device 10 from window pocket 26, while leaving the sheet material 22 properly positioned within window pocket 26.

Figure 7A:
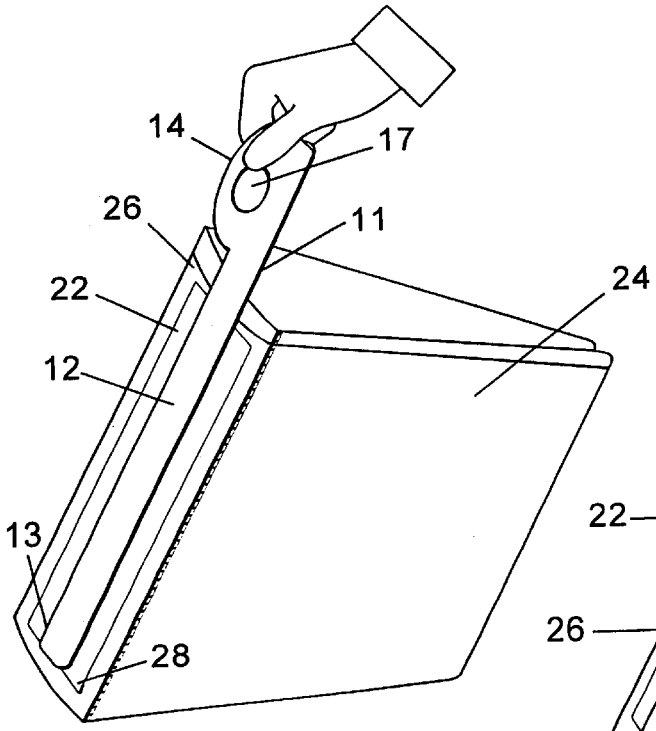
FIGS. 7A and 7C depict the sheet material insertion and removal device of FIG. 1 positioned within the window pocket of a loose-leaf document binder for sheet material removal prior to the start of removal, and at a point just before complete removal.

To remove sheet material 22 from window pocket 26, as shown by FIG. 7A, the device 10 is inserted between clear plastic window pocket 26 and sheet material 22 with the frictional element 19 facing the sheet material 22. The lip portion 18 (FIGS. 2A and 2C) provides for the smooth passage of the second end 13 of the device 10 and the frictional element 19 beyond the top of sheet material 22 without catching or snagging the sheet material 22. Additionally, the pressure generated by the snugness of window pocket 26 prevents the sheet material 22 from buckling during this part of the process.

Figure 7B:
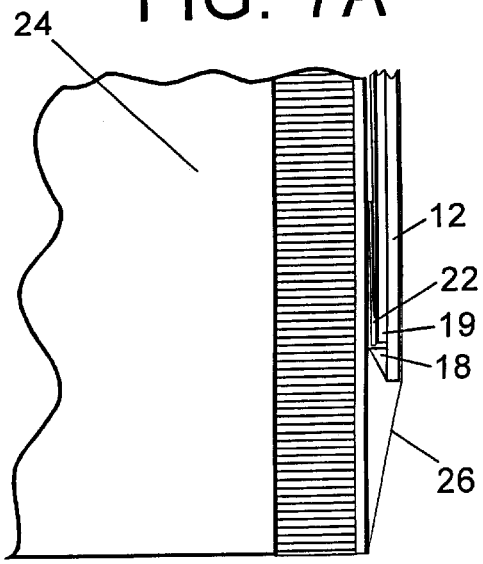
FIG. 7B depicts an enhanced view of the positioning of the device in FIGS. 7A and 7C relative to the sheet material just prior to removal of the sheet material.
Figure 7C:
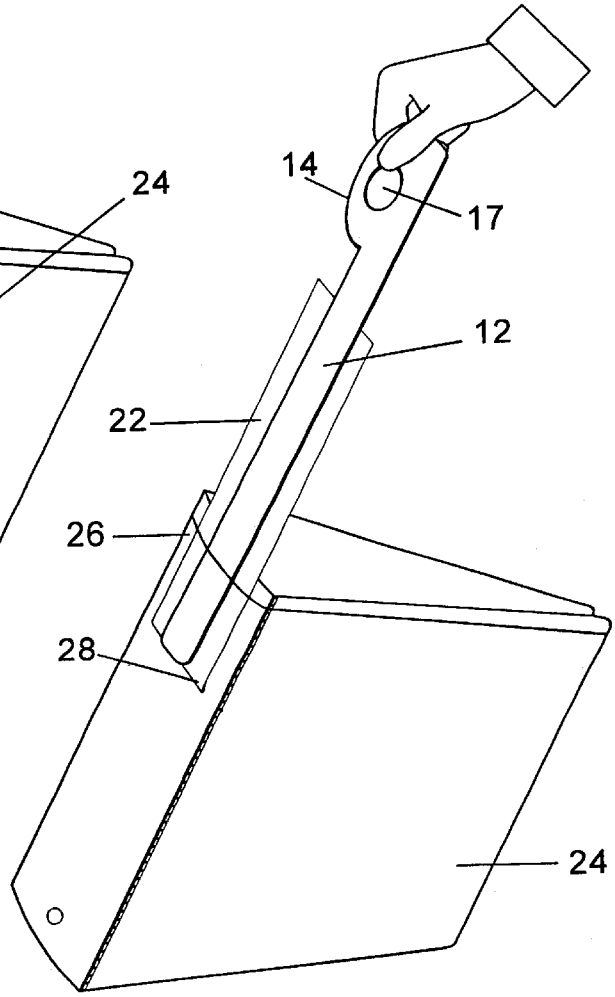

Once the device 10 is inserted into the window pocket 26, the user applies a force which is generally inward, relative to the front and bottom of the window pocket 26. The pressure generated by the snugness of window pocket 26 causes the device 10 to be pressed against sheet material 22 along its longitudinal axis, thereby causing the frictional element 19 to cling to the sheet material 22 (FIG. 7B), and facilitating the removal of the sheet material 22 from window pocket 26 (FIG. 7C). Once the second end 13 of the device 10 has reached substantially the bottom end of the sheet material 22, or has encountered sufficient friction with the label or insert, an outward force is applied, relative to window pocket 26, onto the device 10. If the sheet material 22 was originally inserted with the device of present invention, the fold 28 at the bottom end of the sheet material 22 would further facilitate the removal of the sheet material 22 because the bottom end would be doubled in thickness, such that in the instance wherein insufficient friction exists between the frictional element 19 and the sheet material 22, the thicker bottom end would allow it to more easily be caught by the lip portion 18. Indeed, some sheet material 22 is not conducive to adhering to the frictional element 19, such as, for example, if the sheet material 22 is a slick material. Thus, in these instances, the lip portion 18 acts as an additional backup element for the removal process. Additionally, the pressure from window pocket's 26 snug fit forces the lip portion 18 to catch the bottom of sheet material 22 and further facilitates easy removal of the sheet material.

Once the device 10 is removed from the window pocket 26 it can be easily stored by hanging it from the aperture 17 in the handle 14 or storing it in the three-ring binder via the apertures 16 on the elongated body 12 and, in some embodiments, the aperture 17 in the handle 14. Any other appropriate method of storage may be used as well.

Accordingly, the reader will see that preferred embodiments of the sheet material insertion and removal device 10 can be used to insert and properly position sheet material into a window pocket while avoiding damage to both the window pocket and the sheet material. In addition, when it is desired that previously inserted sheet material be removed, this device quickly, easily and effectively facilitates removal of the sheet material, again avoiding unwanted damage to materials, and effectively overcoming the difficulties associated with the removal of the old sheet material; thereby enhancing productivity when servicing binders and creating a savings in time and money for both the user and a company. As evidenced from the above description of preferred embodiments, other advantages of the sheet material insertion and removal device further include, but are not limited to, (a) The universal design of this device makes it compatible with all items containing window pockets without the need for retrofitting or special manufacturing;

(b) An enhanced level of productivity is achieved when servicing binders under normal circumstances as well as when there is a need for expediency;

(c) Due to the simplicity of its design, this device proves cost effective to manufacture;

(d) A wide range of weight of sheet material may be used with this device, thereby enabling the owner to produce own customized sheet material and save money;

(e) Since sheet material looks better and is more effective in the labeling of binders, this device obviates the need for easily worn and damaged adhesive labels;

(f) Due to its design, the chance of damaging this device beyond use is minimized;

(g) The simple design makes this device extremely easy to store away;

(h) The three-hole embodiment may be easily stored away within the binder itself;

(i) Since the three-hole embodiment of this device is easy to store and cost effective to manufacture, binder manufactures would be able to add it to their product, thereby enhancing marketability and effectively increasing sales;

(j) Production of this device in a variety of color designs and styles can be easily achieved in order to produce multiple versions, including deluxe models;

(k) Due to the flat, elongated design of the device, company logos and slogans can be easily added to even further enhance marketability; and (l) The device extends the usefulness of loose-leaf binders with window pockets by allowing their multiple reuse which in turn creates an ongoing cost savings for a user or company.

Although the description above contains many specifications, including many dimensions, e.g., lengths, widths and angles, for individual elements, these should not be construed as limiting the scope of the invention but as merely providing illustrations of some of the presently preferred embodiments of the invention. For example, the device can have other dimensions, such as a longer overall length, shorter overall length, wider handle portion, longer handle portion, thinner handle portion, thicker handle portion, no handle portion, wider elongated body, slimmer elongated body, thinner elongated body, or thicker elongated body. The handle may be produced separately from the elongated body and joined by any appropriate attachment means or be continuous with the elongated body. The handle or handle portion can also be of a different texture, material or color from the elongated body. Further, the frictional element may be longer, shorter, wider, slimmer, thinner or thicker. It may be one contiguous strip or multiple strips formed from the same or different materials, it may be a surface with frictional characteristics produced upon a surface or a plurality of surfaces of the elongated body or there may be no frictional strip at all. In addition, both the lip portions and stop portions can have different dimensions and can protrude at different angles as well. They can also be wider, thinner, shorter, taller, of different overall shape or any combination of these. Finally, there can be any number of apertures in any combination of shapes, dimensions, spacings or no apertures at all.

In addition, although the descriptions above indicate use with a standard three-ring type loose-leaf binder, the device of the present invention may be used with any item having a window pocket for sheet material and the like.

Although the foregoing described the invention with preferred embodiments, this is not intended to limit the invention. Rather, the foregoing is intended to cover all modifications and alternative constructions falling within the spirit and scope of the invention as expressed in the appended claims.

What I claim is:

1. A method for removing sheet material having a top end and a bottom end in a window pocket, wherein the window pocket comprises an outer overlay surface and an inner surface, each having longitudinal edges, a bottom end and a top end, wherein the surfaces are substantially sealed together along the longitudinal edges and bottom end, and wherein the window pocket has an opening at the top end, comprising the steps of:

providing a sheet material insertion and removal device having a bottom end, wherein the device is sufficiently thin and rigid to be easily inserted into and pulled from the window pocket;

forming a fold parallel with the bottom end of the sheet material at a desired distance from the sheet material;

placing the device within the fold in the sheet material;

inserting the sheet material and the device into the opening of the window pocket;

applying an inward force relative to the window pocket onto the device until the sheet material is inserted within the window pocket to desired position; and removing the device from the window pocket.

2. A method as claimed in claim 1, wherein the step of forming a fold parallel with the bottom end of the sheet material further comprises forming a fold of the sheet material substantially across the width of the sheet material.

3. A method as claimed in claim 1, wherein the step of providing a sheet material device further comprises providing a sheet material insertion and removal device having a stop portion protruding from the device so as to prevent the device from being inserted beyond the opening of the window pocket.

4. A device for inserting and removing sheet material having a top end and a bottom end from a window pocket, wherein the window pocket comprises an outer overlay surface and an inner surface, each having longitudinal edges, a bottom end and a top end, wherein the surfaces are substantially sealed together along the longitudinal edges and bottom end, and wherein the window pocket has an opening at the top end, comprising:

an elongated body having a first end and a second end, a lip portion, wherein the lip portion protrudes outwardly from the second end, and being sufficiently thin as to be easily inserted into and removed from the window pocket, wherein the elongated body is formed from a material providing sufficiently low friction as to prevent adherence to the outer overlay surface, the sheet material and the inner surface, the material further providing sufficient rigidity and flexibility to facilitate use and resist permanent warping and breakage.

5. The device as claimed in claim 4 wherein the body further comprises an aperture.

6. The device as claimed in claim 4 wherein the body further comprises a plurality of apertures.

7. The device as claimed in claim 6, wherein the apertures are sized and positioned on the body so as to align and fit within a multiple-ring document retainer.

8. The device as claimed in claim 4, the device further comprising a stop portion, wherein the stop portion protrudes sufficiently from the top end of the device.

9. The device as claimed in claim 4 wherein the device further includes a handle, wherein the handle resides adjacent the top end of the device.

10. The device as claimed in claim 9 wherein the handle further includes a stop portion, wherein the stop portion protrudes from the handle.

11. The device as claimed in claim 4 wherein the handle and body are separate pieces, and wherein the handle is coupled to the body.

12. The device as claimed in claim 11 wherein the handle includes a stop portion that is capable of preventing the device from being inserted beyond the opening of the window pocket.

13. The device as claimed in claim 4, the device further comprising a frictional element, wherein the frictional element is coupled to the body of the device.

14. The device as claimed in claim 13 wherein the frictional element is a material formed from cork and rubber, wherein the frictional element is capable of sliding against the outer overlay surface and the inner surface and adhering to the sheet material.

15. A device for inserting and removing sheet material having a top end and a bottom end in a window pocket, wherein the window pocket comprises an outer overlay surface and an inner surface, each having longitudinal edges, a bottom end and a top end, wherein the surfaces are sealed together along the longitudinal edges and bottom end, and wherein the window pocket has an opening at the top end, comprising:

an elongated body having a first end and a second end, a frictional element, wherein the frictional element is disposed on the elongated body between the first and second end, and being sufficiently thin as to be easily inserted into and removed from the window pocket, wherein the elongated body is formed from a material providing sufficiently low friction to prevent adherence to the outer overlay surface, the sheet material and the inner surface, the material further providing sufficient rigidity and flexibility to facilitate use and resist permanent warping and breakage.

16. The device as claimed in claim 15 the device further comprising a lip portion, wherein the lip portion protrudes from the device.

17. The device as claimed in claim 8, wherein the frictional element further comprises a tapered end, wherein the tapered end resides adjacent the second end of the body.

18. A tool for inserting and removing labels from retainers comprising:

an elongated body having a first end and a second end;

an frictional element coupled to the elongated body; and a flange disposed at the second end of the body wherein the flange protrudes outward from the plane of the body.

19. A tool as claimed in claim 18 further comprising a handle coupled to the first end of the body.

20. A tool as claimed in claim 19, wherein the body and handle are manufactured as a single unitary piece.

21. A tool as claimed in claim 18 wherein the handle includes a concave portion.

22. A device for inserting and removing sheet material having a top end, a bottom end, and edges, in a window pocket, wherein the window pocket comprises an outer overlay surface and an inner surface, each having longitudinal edges, a bottom end and a top end, wherein the surfaces are sealed together along the longitudinal edges and bottom end, and wherein the window pocket has an opening at the top end, comprising:

an elongated body having a first end and a second end, a front surface and a back surface, wherein the front surface facilitates adherence of the sheet material to the device and wherein the back surface is formed from a material providing sufficiently low friction to prevent adherence to the outer overlay surface, the sheet material and the inner surface; and a lip portion, wherein the lip portion is smaller than the elongated body and is configured to catch an edge of the sheet material.

23. A device as claimed in claim 22 wherein the front surface is formed by the overlay of a strip which provides sufficiently high friction to facilitate adherence to the sheet material to the device.

24. A device as claimed in claim 22, wherein the front surface is formed by tooling, wherein the process of tooling creates a surface which provides sufficiently high friction to facilitate adherence to the sheet material to the device.

25. The device as claimed in claim 4, wherein the lip portion is configured to catch an edge of the sheet material.

* * * * *